US006513571B1

(12) United States Patent
Prieto

(10) Patent No.: US 6,513,571 B1
(45) Date of Patent: Feb. 4, 2003

(54) APPARATUS FOR AUTOMATIC REFILLING OF A LOW PRESSURE CASTING MACHINE

(75) Inventor: Romulo A. Prieto, Northville, MI (US)

(73) Assignee: Hayes Lemmerz International, Inc., Northville, MI (US)

( * ) Notice: Subject to any disclaimer, the term of this patent is extended or adjusted under 35 U.S.C. 154(b) by 0 days.

(21) Appl. No.: 09/321,024

(22) Filed: May 27, 1999

Related U.S. Application Data

(60) Provisional application No. 60/086,923, filed on May 27, 1998.

(51) Int. Cl.[7] ..... B22D 37/00; B22D 17/04; B22D 17/32

(52) U.S. Cl. ..... 164/337; 164/312; 164/155.2; 164/155.4

(58) Field of Search ..... 164/119, 337, 164/136, 312, 155.2, 155.4

(56) References Cited

U.S. PATENT DOCUMENTS

| | | | | | |
|---|---|---|---|---|---|
| 3,989,088 | A | | 11/1976 | Weissman et al. | 164/157 |
| 4,076,070 | A | * | 2/1978 | Lefebvre et al. | 164/303 |
| 4,431,046 | A | | 2/1984 | Phillips | 164/119 |
| 4,436,500 | A | | 3/1984 | Allen et al. | 425/290 |
| 4,450,981 | A | * | 5/1984 | Haig | 222/61 |
| 4,635,706 | A | * | 1/1987 | Behrens | 164/133 |
| 5,125,450 | A | * | 6/1992 | Kidd et al. | 164/133 |
| 5,174,361 | A | | 12/1992 | Kursfeld | 164/453 |
| 5,590,681 | A | | 1/1997 | Schaefer et al. | 137/375 |
| 5,657,812 | A | * | 8/1997 | Walter | 164/113 |
| 5,725,043 | A | | 3/1998 | Schaefer et al. | 164/119 |
| 5,913,358 | A | * | 6/1999 | Chadwick | 164/457 |

* cited by examiner

*Primary Examiner*—Tom Dunn
*Assistant Examiner*—I.-H. Lin
(74) *Attorney, Agent, or Firm*—MacMillan, Sobanski & Todd, LLC

(57) ABSTRACT

A low pressure casting machine having a fill line connected between a thermally insulated chamber and a refractory furnace. A solenoid valve is included in the fill line and is selectively opened to allow gravity to fill the thermally insulated chamber to a predetermined level with molten metal. The thermally insulated chamber is subsequently pressurized to force molten metal from the chamber into a mold cavity to cast a metal component.

8 Claims, 5 Drawing Sheets

APPARATUS FOR AUTOMATIC REFILLING OF A LOW PRESSURE CASTING MACHINE

CROSS REFERENCE TO RELATED APPLICATIONS

This application claims the benefit of U.S. Provisional Application No. 60/086,923, filed on May 27, 1998.

BACKGROUND OF THE INVENTION

This invention relates in general to low pressure casting machines and in particular to an apparatus and process for automatic refilling of a low pressure casting machine.

Many vehicle components, including wheels and full face wheel discs are cast in permanent multi-piece molds from alloys of light weight metals, such as aluminum, magnesium and titanium. Due to the large volume of parts needed, the casting processes are highly automated. Two frequently utilized casting processes are gravity-poured and low pressure casting. Gravity-poured casting involves pouring a charge of molten metal into a mold cavity. Gravity causes the molten metal to fill the mold cavity while gases within the mold cavity are forced out of mold vents. Riser cavities are formed in the upper portions of the mold cavity to assure that the mold cavity is completely filled and to feed additional molten metal into the mold to compensate for metal shrinkage as the casting cools and solidifies. After the casting is removed from the mold, the risers are removed and re-melted.

Low pressure casting involves forcing molten metal into the cavity mold under a low pressure, which, for casting wheel components, is typically within a range from approximately six psi to approximately seven psi. The pressure assures that the mold cavity is completely filled with molten metal. Typically, because the pressure force-fills the mold, the size of the riser cavities can be reduced, or the riser cavities may be eliminated entirely. Accordingly, less molten metal is needed for each casting and the need to re-melt the risers is reduced or eliminated. Additionally, low pressure casting facilitates casting of more complex shapes since the pressure forces the molten metal into all the portions of the mold cavity. Also, low pressure casting usually runs at lower mold temperatures and shorter cycle times than conventional gravity-poured casting processes. The rapid solidification rates associated with low pressure casting processes result in castings with finer grain size, smaller spacing between dendrite arms and enhanced mechanical properties.

Referring now to the drawings, there is illustrated in FIG. 1 a typical known low pressure casting machine 10. The machine 10 includes a thermally insulated lower chamber 11 which holds a pool of molten metal 12. A filler tube 13 extends through a side of the lower chamber 11 from above the maximum height of the metal pool 12. A removable filler cap 14 is mounted upon the upper end of the filler tube 13. When closed, the filler cap 14 forms an air-tight seal for the lower chamber 11. A pressurization port 14A is formed through the lower chamber walls to allow pressurization of the chamber 11. Similarly, a vent port 14B is formed through the lower chamber walls to allow venting of the chamber 11.

A multi-piece mold 15 is typically mounted above the lower chamber 11; however, the chamber 11 is not necessarily positioned below the mold 15. As illustrated in FIG. 1, the mold 15 includes an upper member 16 which cooperates with a lower member 17 to form a mold cavity 18. For simplicity, a two piece mold 15 is illustrated in FIG. 1. A hollow fill tube, or stalk, 19 extends from the mold 15 and through the top of the casting machine's lower chamber 11.

The lower end of the stalk 19 extends into the pool of molten metal contained within the chamber 11. The upper end of the stalk 19 extends through the lower mold member 17 and communicates with the mold cavity 18. The upper mold member 16 is attached to a conventional mechanism 20 which raises the upper member 16 to allow removal of the casting from the mold cavity 18. Once the casting is removed from the mold cavity 18, the mechanism 20 is reversed to lower the upper member 16 and re-close the mold 15.

To operate the low pressure casting machine 10, the filler cap 14 is opened and molten metal poured into the filler tube 13 to fill the lower chamber 11 to the level of the lower end of the filler tube 13. The filler tube 13 is then cleared of molten metal and the filler cap 14 closed and sealed. The mold 15 is closed and a pressurized gas is introduced through the pressurization port 14A into the lower chamber 11. The pressurized gas forces molten metal up the stalk 19 and into the mold cavity 18, as shown by the small arrows in FIG. 1. The pressure is maintained while the molten metal in mold cavity 18 solidifies into a casting for a component. The pressurized gas is then vented from the lower chamber 11 through the vent port 14B and the upper mold member 16 is raised to open the mold 15 opened for removal of the casting from the mold cavity 18. The upper mold member 16 is lowered to close the mold 15 and the lower chamber 11 re-pressurized to cast another component.

After each casting, the level of molten metal remaining in the lower chamber 11 is reduced. Accordingly, after a number of components are cast, the filler cap 14 is re-opened and the chamber 11 refilled with molten metal. The molten metal is typically manually transported to the individual casting machine from a centrally located refractory furnace in a thermally insulated covered ladle. Because the lower end of the filler tube 13 is some distance above the surface of the remaining metal when refilling occurs, the molten metal being added to the lower chamber 11 tends to cascade into the chamber 11.

SUMMARY OF THE INVENTION

This invention relates to an apparatus and process for automatic refilling of a low pressure casting machine.

The prior art low pressure casting machine described above has a number of disadvantages. While the lower chamber is being refilled, the casting machine is out of service, which results in a loss of production and loss of mold temperature. Refilling the lower chamber of the casting machine interrupts the production process, causing process variability and corresponding product quality problems. The transport of molten metal to the casting machine for refilling the lower chamber is labor intensive. Because refilling requires pouring molten metal from a ladle and though a filler tube into the lower chamber, there is a chance that some of the molten metal could be spilled. Accordingly, the refilling process is hazardous. Manual refilling of the lower chamber is the last barrier to a fully automated low pressure casting process.

The agitation and turbulence caused by molten metal cascading from the filler tube into an almost empty lower chamber is conductive to generating oxidation byproducts and air bubbles which can be entrapped in the molten metal. When the oxidation byproducts and air bubbles are then cast into the component, the resulting product may have to be scrapped. Such raw material level variations are a source of process variability introduced by the traditional manual refilling process for the lower chamber.

Accordingly, it would be desirable to provide an apparatus for automatically refilling the lower chamber of a low pressure casting machine.

The present invention contemplates a low-pressure casting machine having a thermally insulated chamber adapted to retain a supply of molten metal and a mold having a cavity which communicates with the chamber. The machine also includes a pressurization device communicating with the chamber which is selectively operative to supply a pressurized gas to the chamber to force molten metal from the chamber into the mold cavity. The machine further includes a fill line communicating with the chamber, the fill line being operative to supply molten metal into the chamber. A normally closed fill valve is disposed in the fill line. The fill valve is selectively operative to control the flow of molten metal through the fill line and into the chamber.

In the preferred embodiment, the fill valve is actuated by a solenoid and the fill line communicates with a refractory furnace which supplies molten metal to the fill line. Gravity urges the molten metal from the furnace to the chamber. The fill line can be sloped, or the furnace can be at a higher elevation than the thermally insulated chamber, to enhance the flow of molten metal through the fill line.

Additionally, the casting machine includes a vent which communicates with the chamber. The vent is selectively operable to release the pressurized gas from within the chamber. The casting machine further includes a mechanism attached to a portion of the mold which selectively opens and closes the mold. A level sensor is optionally mounted within the thermally insulated chamber. The sensor is coupled to the fill valve solenoid and is operative, upon said molten metal within the thermally insulated chamber reaching a predetermined level, to cause the fill valve to close.

It is further contemplated that the casting machine is one of a plurality of casting machines. The casting machines are connected by associated fill lines to the refractory furnace. Each of the fill lines includes a fill valve which is selectively operable to control the flow of molten metal from the refractory furnace to the casting machines.

The invention also contemplates a process for casting a metal component which includes providing the above described casting machine. The chamber is pressurized to force molten metal from the chamber into the mold cavity. The molten metal in the mold cavity is allowed to solidify to form a casting. The chamber is then depressurized. The mold and the fill valve are opened to remove the casting and to allow molten metal to flow into the chamber to replace the molten metal used to form the casting. After the casting is removed from the opened mold, the mold and fill valve are closed.

The process further includes, prior to pressurizing the chamber, opening the fill valve to initially fill the chamber with molten metal and allowing the temperature of the casting machine to stabilize. In the preferred embodiment, the mold is for casting a vehicle wheel component.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
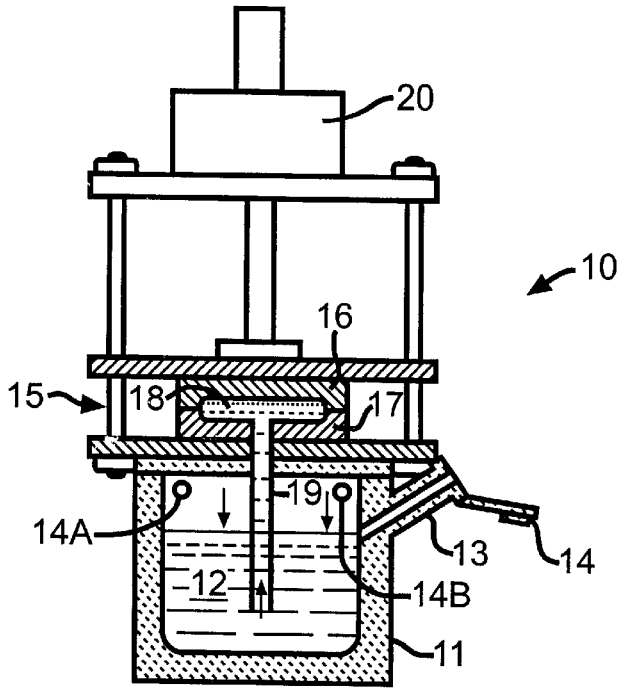
FIG. 1 (PRIOR ART)
FIG. 1 is a sectional view of a prior art low pressure casting machine.
Figure 2:
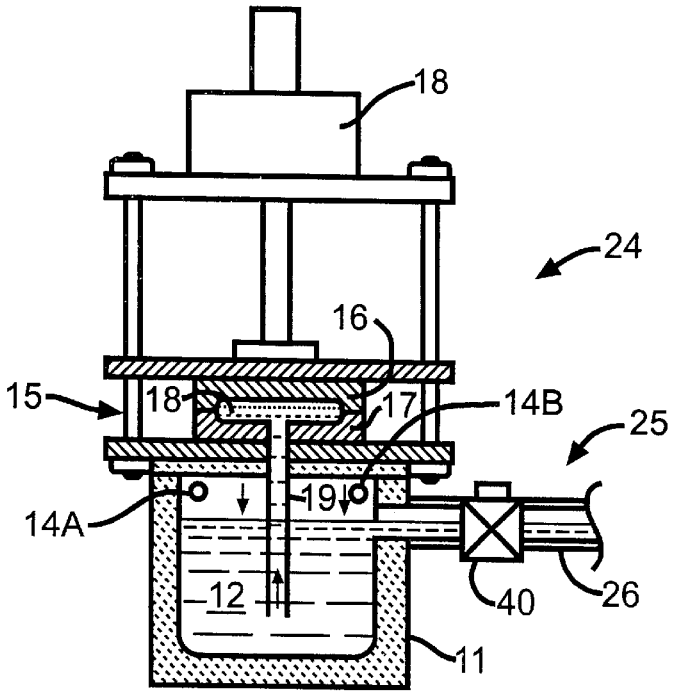
FIG. 2 is a sectional view of a low pressure casting machine in accordance with the present invention.

Referring again to the drawings, there is illustrated in FIG. 2 an improved low pressure casting machine 24 which includes an automatic refilling apparatus 25 in accordance with the present invention. Components shown in FIG. 2 which are similar to components shown in FIG. 1 have the same numerical designators. The automatic refilling apparatus 25 includes a thermally insulated fill line 26 which, as shown in FIG. 3, extends from the lower chamber of the casting machine 24 to a conventional refractory furnace 30.

Figure 3:
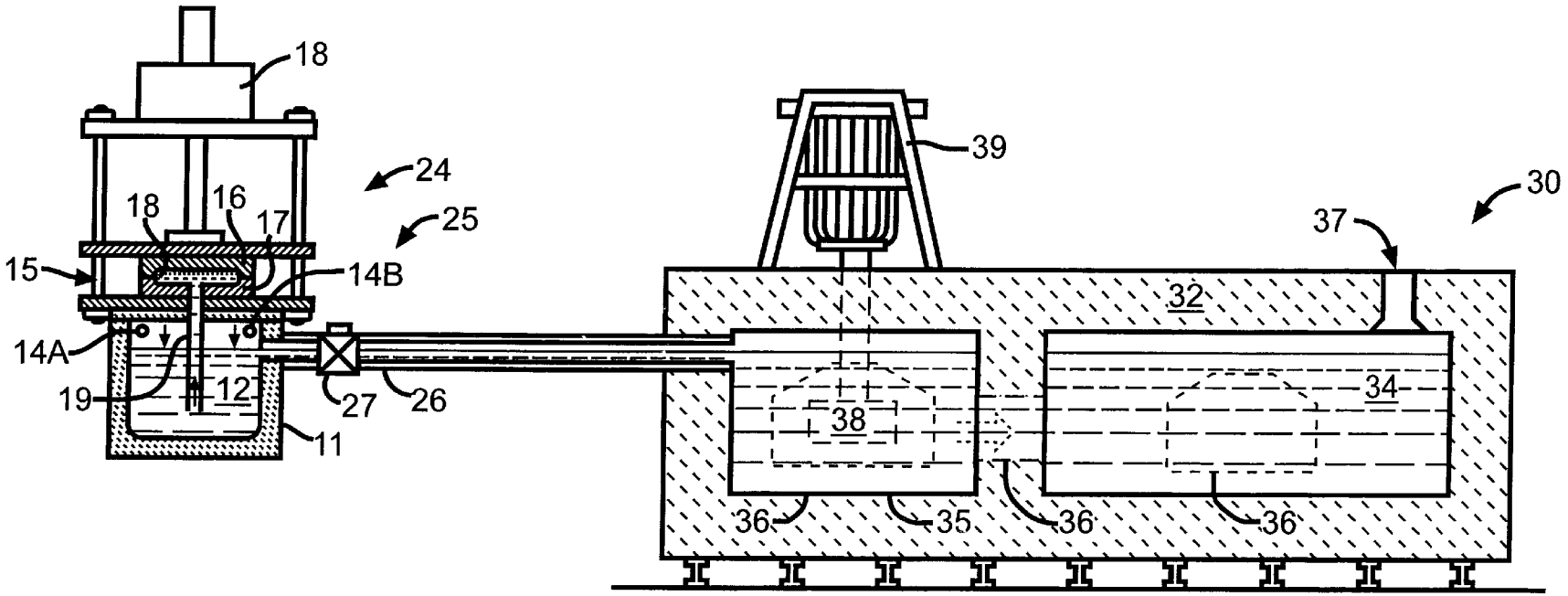
FIG. 3 is an elevation view of the low pressure casting machine shown in FIG. 2 connected to a refractory furnace.
Figure 4:
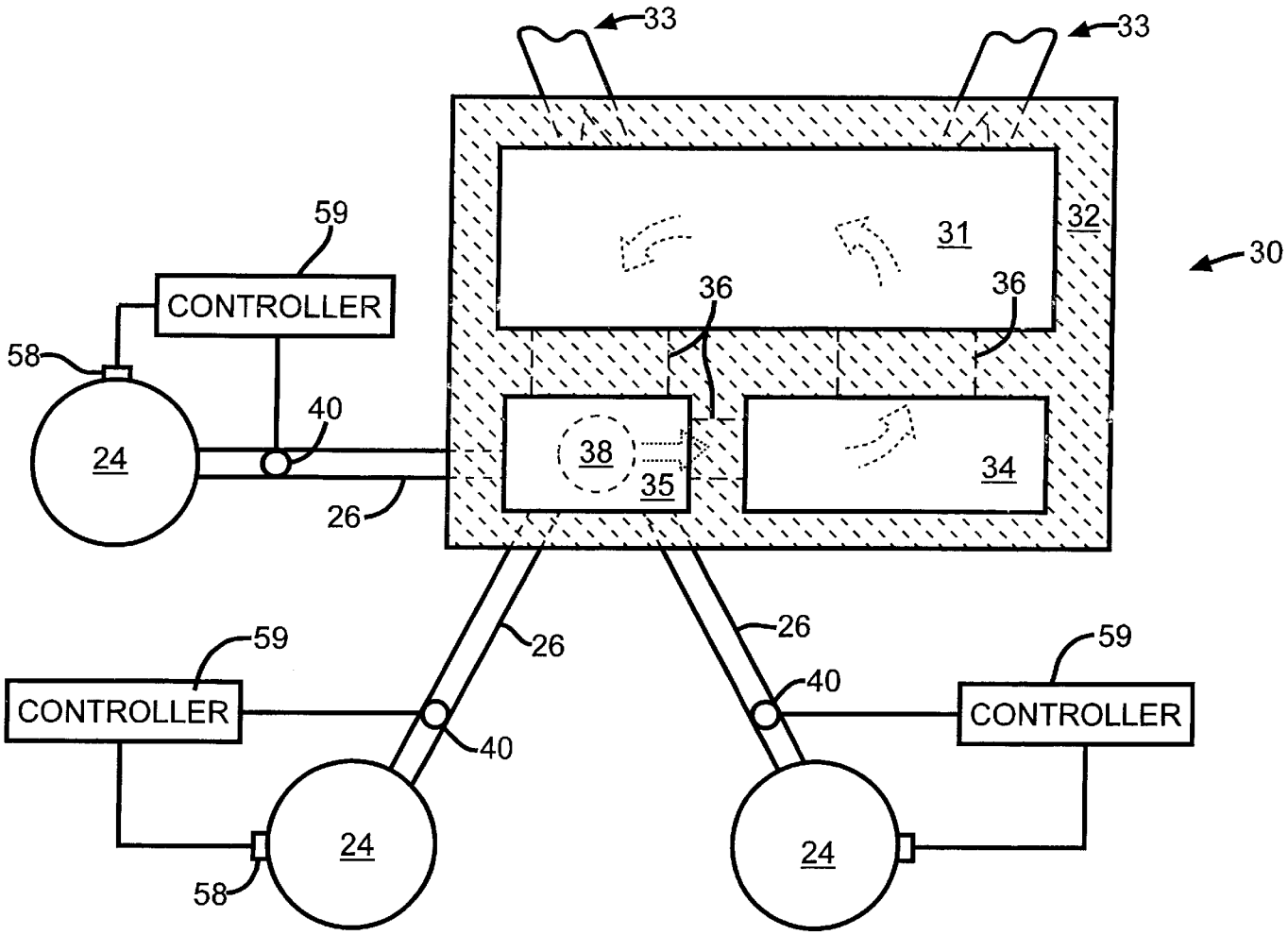
FIG. 4 is a plan view of the low pressure casting machine and refractory furnace shown in FIG. 3.

The refractory furnace 30, which is illustrated in FIGS. 3 and 4, includes a main chamber 31 which is lined with a refractory material 32 and heated by combustion burners 33 fed by natural gas or fuel oil. The furnace 30 also includes a charge well 34 and a circulation well 35 which communicate through passageways 36 with one another and the main chamber 31. Metal is inserted through an opening 37 into the charge well 34 and is melted into a pool which is contained within the main chamber 31. A pump 38 powered by an electric motor 39 circulates the molten metal between the main chamber 31 and the charge and circulation wells 34 and 35 as shown by the dashed arrows in FIGS. 3 and 4.

The end of the fill line 26, which is to the right in FIG. 2, is connected to the refractory furnace circulation well 35 and thereby communicates with the pool of metal which is maintained in a molten state within the refractory furnace 30. In the preferred embodiment, the refractory furnace pool of molten metal is maintained at a slightly higher elevation than the lower chamber 11 of the casting machine 24. Accordingly, gravity urges the molten metal through the fill line 26 from the refractory furnace and into the lower chamber 11. Also in the preferred embodiment, the refractory furnace 30 is connected though multiple fill lines 26 to a plurality of low pressure casting machines 24, as illustrated by the plan view in FIG. 4.

Figure 5:
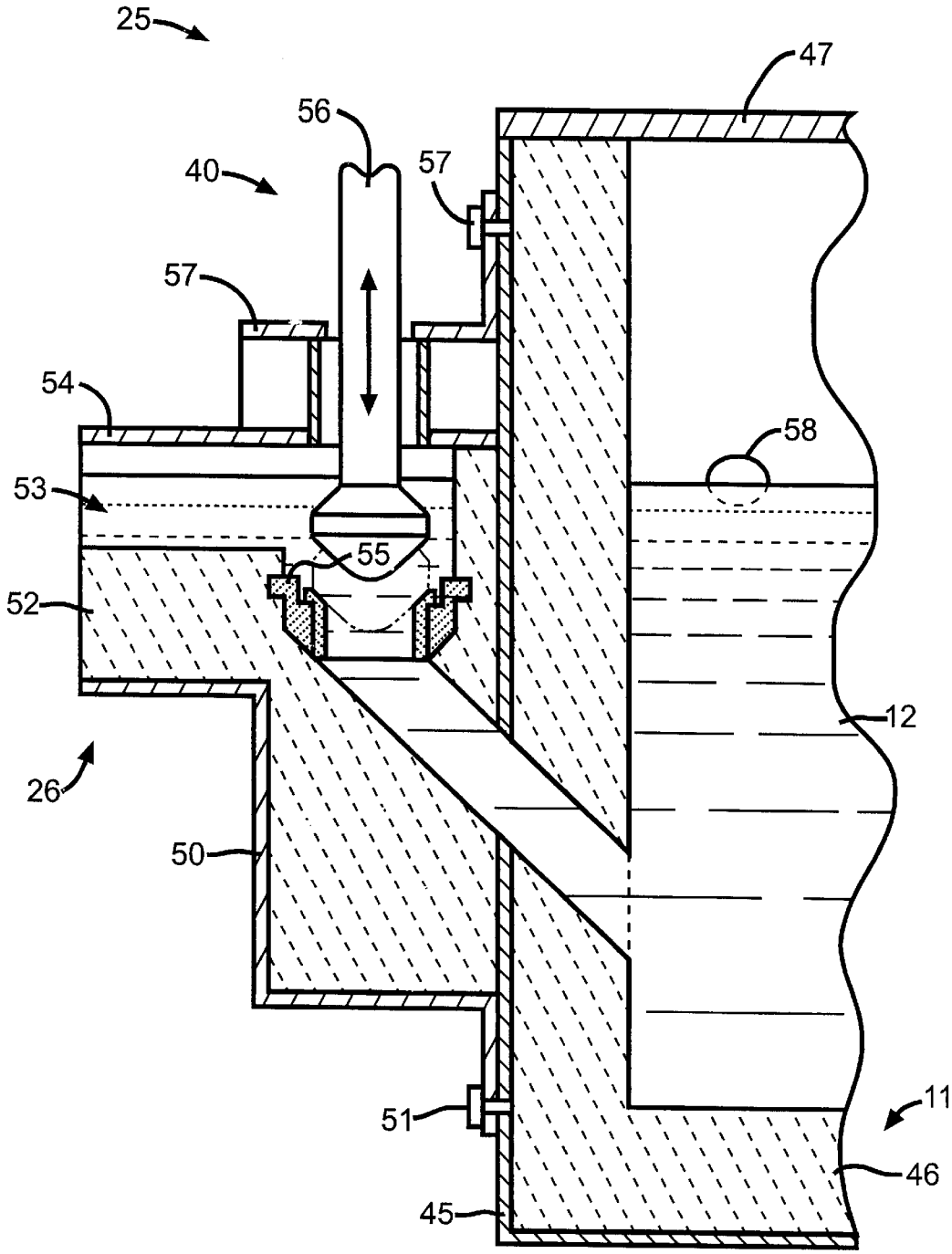
FIG. 5 is a detail sectional view of an automatic refilling apparatus which is included in the low pressure casting machine shown in FIG. 2.

The automatic refilling apparatus 25 also includes a normally closed solenoid operated fill valve 40 which is disposed in the fill line 26 and controls the flow of molten metal therethrough. A sectional view of the automatic refilling apparatus 25 is shown in FIG. 5, where components which are similar to components shown in FIG. 2 have the same numerical designators. As shown in FIG. 5, the lower chamber 11 includes a vessel 45 having a lining 46 formed from a refractory material. A cover 47 extends across the top of the vessel 45. The fill line 26 includes an outer housing 50 which is attached to the wall of the vessel 45 by a plurality of fasteners 51 (one shown). The fill line housing 50 has a lining 52 formed from a refractory material. A channel 53 is formed in the fill line lining 52. The channel 53 extends through a side wall of the vessel 45 and the refractory lining 46 of the lower chamber 11 to communicate with the pool of molten metal 12 contained therein. A removable cover 54 extends over the channel 53. The cover 54 is removed when the casting machine 24 is out of service to allow cleaning the channel 53. The fill line 26 also can include optional electric heating elements (not shown) embedded within the refractory material. Such heating elements assure that the metal contained in the channel 53 remains in a molten state.

The fill valve 40 includes an annular valve seat 55 which is disposed within the fill line channel 53 and an axially movable valve stem 56. The valve seat 55 and valve stem 56 are formed from a highly heat resistant material, such as, for example, a ceramic. The valve stem 56 is supported by a mounting structure 57 which is attached to the top of the fill line 50 and the wall of the lower chamber 11 by a plurality of fasteners 57 (one shown). As shown by the double headed arrow in FIG. 5, the valve stem 56 is movable in upward and downward directions. A conventional solenoid actuator (not shown) is attached to the upper end of the valve stem 56 to move the valve stem 56. When moved down, the valve stem 56 co-operates with the valve seat 55 to block the flow of molten metal from the fill line 26 into the lower chamber 11. Similarly, when the solenoid actuator raises the valve stem 56 from the valve seat 56, gravity urges molten metal to flow from the fill line 26 into the lower chamber 11 to replenish the pool contained therein. The present invention contemplates that the solenoid for operating the fill valve 53 is electrically connected to the casting machine controller (not shown) to allow automatic operation of the valve 53 during casting operations, as will be described below.

The casting machine 24 also can include an optional level sensor 58 for determining the depth of the molten metal contained in the lower chamber 11. The sensor 58 is of a conventional design and generates an electrical signal upon the molten metal reaching the sensor lever. The function of the level sensor 58 will be described below.

Figure 6:
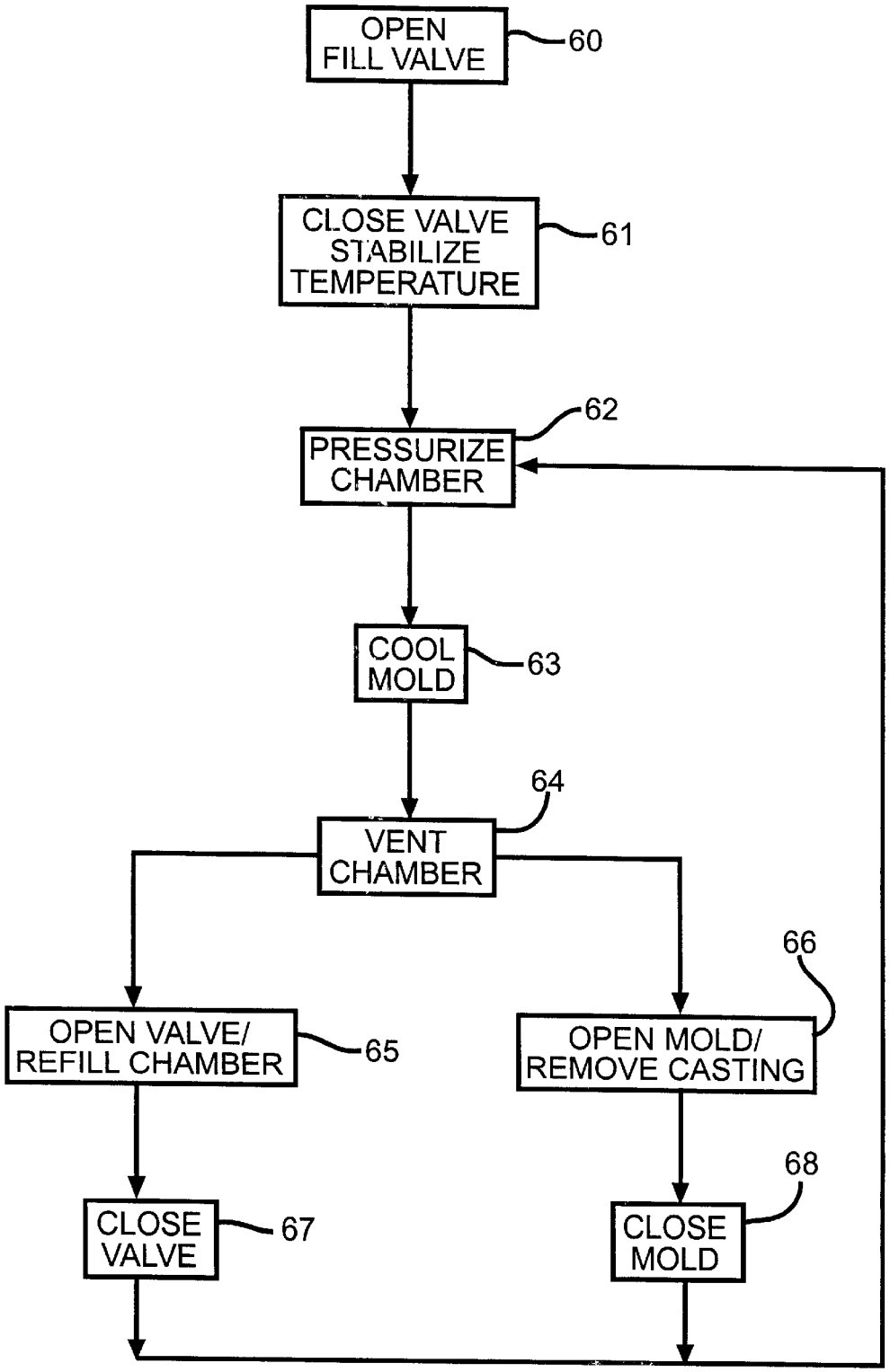
FIG. 6 is a flow chart for a low pressure casting process which utilizes the machine shown in FIG. 2.

The operation of the improved low pressure casting machine 24 will now be described. A flow chart for the operation is shown in FIG. 6. In functional block 60, the solenoid valve 40 is opened for an initial filling of the lower chamber 11. Gravity will fill the lower chamber 11 of the casting machine 24 until the depth is equal to the height of the molten metal in the fill line 26. The fill valve 40 is closed and the temperature of the casting machine 24 is allowed to stabilize in functional block 61. The lower chamber 11 is pressurized through the pressurization vent 14A with a gas in functional block 62 to force molten metal up the stalk 19 and into the mold cavity 18. While the lower chamber 11 is pressurized, the closed fill valve 40 also functions to prevent the back flow of molten metal through the fill line 26. In functional block 63, the mold 15 is allowed to cool sufficiently for the molten metal in the mold cavity 18 to solidify. The pressurized gas is vented from the lower chamber 11 through the vent port 14B of the casting machine in functional block 64. Next, in functional block 65, the fill valve 40 is opened to allow molten metal to flow into the lower chamber 11. As explained above, gravity will replace the amount of molten metal used to cast the component in functional block 62.

At the same time that the fill valve 40 is opened, the mold 15 is opened and the casting removed, as shown in functional block 66. After a sufficient time has passed to allow replenishment of the molten metal in the lower chamber 11 of the casting machine, the fill valve 40 is closed in functional block 67. At the same time that the fill valve is closed, the mold 15 is re-closed in functional block 68. The process then returns to functional block 62 for casting another component.

The simultaneous opening of the mold 15 and fill valve 40 reduces casting cycle time and thus improves casting machine efficiency. Similarly, the simultaneous closing of the mold 15 and fill valve 40 also reduces casting cycle time. While the preferred embodiment of the process has been described with the fill valve 40 and mold 15 being opened and closed together, it will be appreciated that the process also can be practiced with these steps occurring sequentially.

As indicated above, in the preferred embodiment, the refractory furnace circulation well 38 is at a higher elevation than the casting machine lower chamber 11 to facilitate the flow of molten metal from the circulation well 38 to the lower chamber 11. Accordingly, the level sensor 58 described above is connected though a conventional control circuit, or controller 59, to the fill valve 40, as illustrated in FIG. 4. During a fill cycle, the level sensor would generate a chamber full signal upon the molten metal in the lower chamber 11 reaching the sensor 58. The chamber full signal would cause to control circuit to close the fill valve 40 and thereby prevent overfilling the lower chamber 11.

Alternately, the fill level for the lower chamber 11 can be at the same elevation as the level of molten metal in the refractory furnace 30 with the fill line 26 sloped in a downward direction from the furnace 30 to the casting machine 24. The downward slope of the fill line 26 would enhance the urging of the force of gravity upon the molten metal in the fill line 26. Accordingly, the level of the molten metal in the lower chamber 11 would rise to the level of the molten metal in the furnace 30 without the necessity of a level sensor 58 to prevent overfilling.

It will be further appreciated that the invention also may be practiced with a horizontal fill line 26, as illustrated in FIG. 3. Gravity would urge the molten metal though the fill line 26 to refill the lower chamber 11.

The improved low pressure casting machine 24 provides an increased throughput since the casting machine does not have to be stopped for refilling the lower chamber 11. Little, if any, labor is required to move molten metal from a centrally located refractory furnace to the casting machine. Additionally, the hazardous process of refilling the lower chamber from a ladle is eliminated. The absence of interruptions to refill the lower chamber eliminates mold cool down and thereby provides a more robust process. The flow of the molten metal from the refractory furnace to the lower chamber is absolutely quiescent. The casting process can be: fully automated which results in process consistency, higher throughput of castings and higher quality castings produced with an improved quality yield. Because the lower chamber is refilled after every component is cast, the level of molten metal within the lower chamber is essentially constant, which eliminates one more variable in the casting process. Refilling the lower chamber after each casting cycle assures maintenance of a uniform molten metal temperature within the lower chamber.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope. For example, while the preferred embodiment of the process has been illustrated and explained in terms of casting vehicle wheel components, it will be appreciated that the process also can be practiced for casting other components.

What is claimed is:

1. A low-pressure casting machine for casting wheel components, the machine comprising:

a thermally insulated chamber adapted to retain a supply of molten metal;

a mold having a cavity which communicates with said chamber;

a pressurization device communicating with said chamber, said pressurization device being selectively operative to apply a pressure within said chamber to force molten metal from said chamber into said mold cavity;

a vent communicating with said chamber, said vent being selectively operable to release said pressure from within said chamber after said mold cavity has filled and said mold has cooled sufficiently for the molten metal within said mold cavity to solidify;

a fill line having a first end and a second end, said first end of said fill line communicating with said chamber;

a central source of molten metal that is separated from said chamber, said source of molten metal communicating with said second end of said fill line, said source of molten metal and said fill line being positioned relative to said chamber such that gravity urges said molten metal through said fill line from said source of molten metal and directly into said chamber with a non-turbulent flow;

a normally closed fill valve disposed in said fill line, said valve being selectively operative to control the flow of molten metal through said fill line and into said chamber; and a solenoid connected to said fill valve, said solenoid operative to open said fill valve while said vent is actuated to release said pressure from within said chamber and to close said fill valve while said pressurization device is actuated whereby the flow of molten metal into said thermally insulated chamber is controlled.

2. The casting machine according to claim 1 wherein said fill line communicates with a refractory furnace, said refractory furnace containing a supply of molten metal.

3. The casting machine according to claim 2 further including a mechanism attached to a portion of said mold, said mechanism selectively operable to open and close said mold.

4. The casting machine according to claim 3 further including a level sensor mounted within said thermally insulated chamber, said sensor coupled to said fill valve solenoid and operative, upon said molten metal within said thermally insulated chamber reaching a predetermined level, to cause said fill valve to close.

5. The casting machine according to claim 3 wherein said mold is for casting a wheel component.

6. The casting machine according to claim 3 wherein the casting machine is one of a plurality of casting machines, said casting machines connected by associated fill lines to said single refractory furnace, each of said fill lines including a fill valve which is selectively operable to control the flow of molten metal from said refractory furnace to said casting machines.

7. The casting machine according to claim 1 wherein said fill line communicates with a refractory furnace which contains a pool of molten metal at a higher elevation than said molten metal retained within said thermally insulated chamber, whereby gravity urges said molten metal to flow through said fill line from said refractory furnace to said thermally insulated chamber.

8. The casting machine according to claim 1 wherein said fill line communicates with a refractory furnace which contains a pool of molten metal and further wherein said fill line slopes between said refractory furnace and said thermally insulated chamber, whereby gravity urges said molten metal to flow through said fill line from said refractory furnace to said thermally insulated chamber.

* * * * *